US005133187A

United States Patent [19]

Beaudreault et al.

[11] Patent Number: 5,133,187

[45] Date of Patent: Jul. 28, 1992

[54] FLUID CIRCUIT FOR MAINTAINING CONSTANT PRESSURE BETWEEN TWO ABUTTING SOLID OBJECTS

[75] Inventors: James J. Beaudreault, North Providence, R.I.; James O. Gallant, Dighton, Mass.

[73] Assignee: SW Industries, Inc., Providence, R.I.

[21] Appl. No.: 628,408

[22] Filed: Dec. 14, 1990

[51] Int. Cl.[5] ..... F15B 7/00

[52] U.S. Cl. ..... 60/533; 60/546; 60/562; 60/581; 92/98 D; 226/191

[58] Field of Search ..... 92/98 D; 60/533, 562, 60/546, 581; 226/191, 194, 175; 26/51.4, 100

[56] References Cited

U.S. PATENT DOCUMENTS

| | | | |
|---|---|---|---|
| 2,950,739 | 8/1960 | Lofink | 92/98 D X |
| 3,039,127 | 6/1962 | Molenaar | 92/98 D X |
| 3,375,759 | 4/1968 | Smith | 92/98 D |
| 3,579,989 | 5/1971 | Stark et al. | 60/546 X |
| 3,854,646 | 12/1974 | Dorfel et al. | 226/191 |
| 4,692,971 | 9/1987 | Ginter | 26/103 |

FOREIGN PATENT DOCUMENTS

| | | | |
|---|---|---|---|
| 814172 | 6/1969 | Canada | 92/15 |

*Primary Examiner*—Edward K. Look
*Assistant Examiner*—Todd Mattingly
*Attorney, Agent, or Firm*—Lorusso & Loud

[57] ABSTRACT

A fluid circuit assembly for maintaining substantially constant pressure between two abutting solid objects, the circuit assembly comprising a master cylinder assembly, a plurality of working cylinder assemblies, piston rods extending from the working cylinder assemblies, a spool on distal ends of the piston rods adapted to engage a surface against which it is desired to maintain constant pressure, the master cylinder and the working cylinders having first chambers in communication with a first fluid circuit, the master cylinder having a second chamber in communication with a source of gas under a selected substantially constant pressure, said gas being in communication with a gas reservoir portion of a liquid/gas tank, a liquid reservoir portion of said tank being in communication with second chambers of said working cylinder assemblies, such that upon change of pressure on the spool by the surface, a reaction is generated in the circuit assembly, such as to move the spool to restore a selected pressure between the spool and the surface.

6 Claims, 3 Drawing Sheets

FLUID CIRCUIT FOR MAINTAINING CONSTANT PRESSURE BETWEEN TWO ABUTTING SOLID OBJECTS

BACKGROUND OF THE INVENTION

1. Field of the Invention

This invention relates to fluid circuits for maintaining constant pressure between two abutting solid objects, as for example, a fluid circuit adapted to maintain constant pressure between a compensating roll and a web of flexible material.

2. Description of the Prior Art

Rolls for expanding and contracting flexible materials, such as paper, are known in the art. Such rolls are used for stretching or contracting webs crosswise of their length and for removing wrinkles from moving webs engaged by the rolls. Rolls of the type with which the invention finds utility are curved, or bowed, rolls having a surface of rubber, or the like, mounted on metal segments, generally referred to as spools, or spool assemblies, which are rotatably mounted on a curved axle. Alternatively, the surface may be of metal segments disposed on sections of rubbery material which are rotatable on the curved axle. The opposite ends of the curved axle typically are clamped and are adjustable so that the curved axis of the axle may be set in any selected plane. Such rolls, and the manner of adjustably supporting the rolls, such that the curved axis of the axle thereof may be set in any desired plane, generally function satisfactorily in stretching or contracting webs crosswise of their length, and in removing wrinkles from the webs.

It is found, nevertheless, that in many cases wrinkles in the lengthwise edges of webs are not completely removed because of improper contact with the curved roll. In paper manufacturing, for example, the edges of a web often lengthen more rapidly than the interior body of the web because of differences in temperatures, the physical structure of the paper, and differences in moisture absorption and evaporation. Such often leads to improper edge contact with the curved roll and thus allows wrinkled edges to proceed beyond the curved roll, as illustrated in FIG. 1. In due course, the wrinkled portions of the web must be cut from the web, leading to substantial waste of material.

Recent advances have resulted in tension compensating rolls having end sections which are adjustable to more precisely modify the expansion or contraction of the web along its opposite edges so as to reduce wrinkling of the edges. U.S. Pat. No. 4,692,971, issued Sept. 15, 1987, in the name of James F. Ginter, describes such a compensating roll. The Ginter compensating roll includes a curved axle having a tubular center section and adjustable solid steel end sections. Each of the end sections comprises a shaft fixed to the center tubular section, a hollow tube disposed about the shaft, means on the shaft for pivotally supporting one end of the tube, and means on the shaft for adjustably supporting the other end of the tube to adjust the other end with respect to the shaft.

While the above improvement provides benefits over the prior art, it is necessary that each of the adjustments discussed in the '971 patent be made manually and through trial-and-error. Further, the adjusted positions of the roll must be changed when the web process conditions change.

It would be beneficial to the industry to have a tension compensating roll with end sections which would automatically maintain a substantially constant pressure on the edge areas of a web, and therefore beneficial to have available a fluid circuit which would operate to automatically maintain constant pressure between two abutting solid objects.

SUMMARY OF THE INVENTION

It is, therefore, an object of the invention to provide a fluid circuit which operates to automatically maintain substantially constant pressure between two abutting solid objects, such as a compensating roll and a web of flexible material.

A further object of the invention is to provide a master cylinder assembly of unique design and capabilities and comprising a critical component of the fluid circuit.

With the above and other objects in view, as will hereinafter appear, a feature of the present invention is the provision of a fluid circuit assembly for maintaining substantially constant pressure between two abutting solid objects, the circuit assembly comprising a master cylinder assembly, a plurality of working cylinder assemblies, piston rods extending from the working cylinder assemblies, end means on distal ends of the piston rods adapted to engage a surface against which it is desired to maintain constant pressure, the master cylinder and the working cylinders having first chambers in communication with a first fluid circuit, the master cylinder having a second chamber in communication with a source of gas under a selected substantially constant pressure, the gas being in communication with a gas reservoir portion of a liquid/gas tank, a liquid reservoir portion of the tank being in communication with second chambers of the working cylinder assemblies, such that upon change of pressure on the end means by the surface, a reaction is generated in the circuit assembly such as to move the end means to restore a selected pressure between the end means and the surface.

A further feature of the invention is the provision of a master cylinder assembly provided with double tapered internal walls, a first rolling diaphragm interconnecting walls of the first chamber of the master cylinder with a first pressure surface of a master piston, and a second rolling diaphragm interconnecting walls of a second chamber of the master cylinder with a second pressure surface of the master piston, so as, in operation, to increase the effective area of one of the diaphragms while decreasing the effective area of the other of the diaphragms.

The above and other features of the invention, including various novel details of construction and combination of parts, will now be more particularly described with reference to the accompanying drawings and pointed out in the claims. It will be understood that the particular devices embodying the invention are shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown illustrative embodiments of the invention from which its novel features and advantages will be apparent.

In the drawings.

DESCRIPTION OF THE PREFERRED EMBODIMENTS

Figure 1:
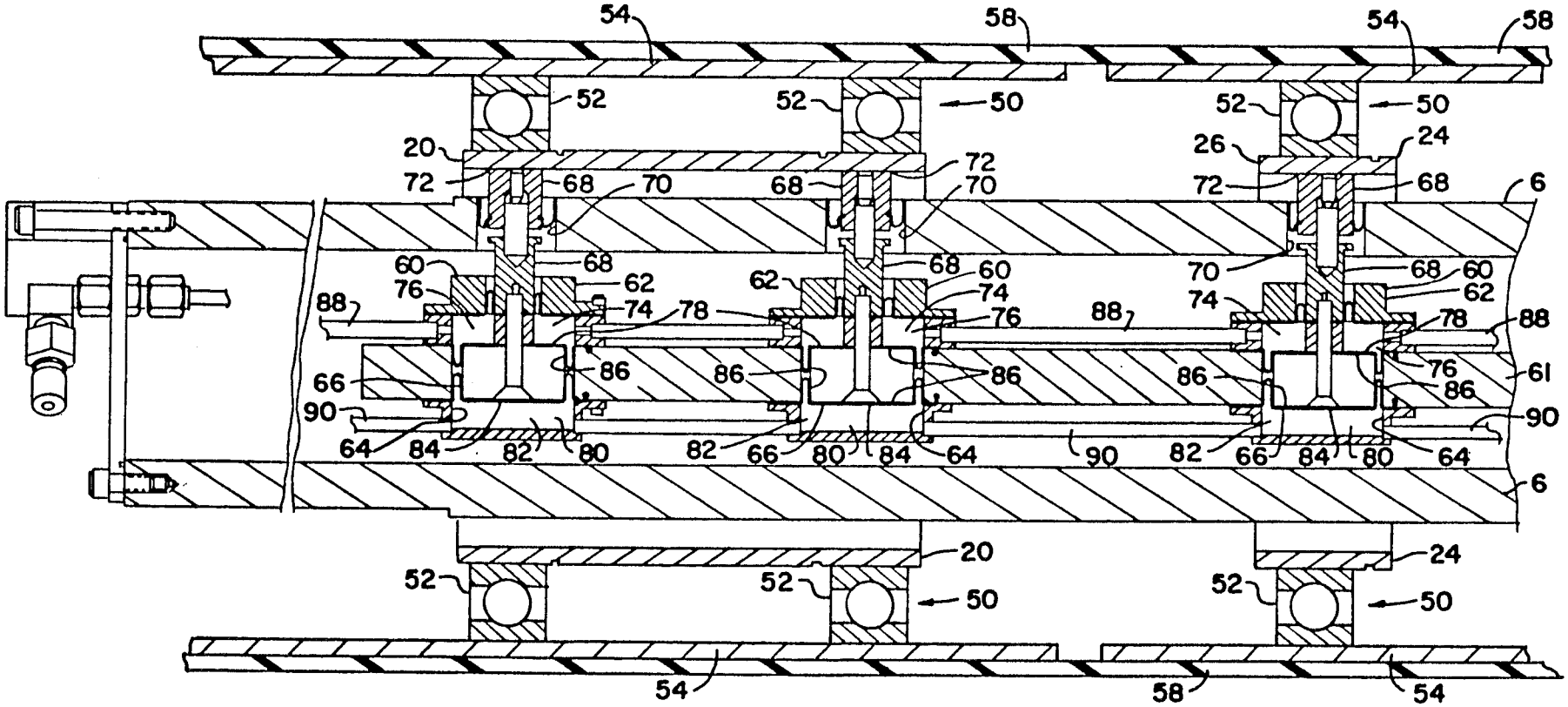
FIG. 1 is a centerline sectional view of a portion of a roll assembly which may be used in conjunction with the invention.

Referring to the drawings, it will be seen that an illustrative embodiment of a roll assembly suitable for use in conjunction with the invention comprises an axle assembly 2 (FIG. 2) including a rigid tubular central or base axle member 4 and a first curved rigid tubular end axle member 6 having one end 8 fixed to a first end 10 of the central axle member. A second curved rigid tubular end axle member 12 may be fixed at one end 14 to a second end 16 of the central axle member 4.

Figure 2:
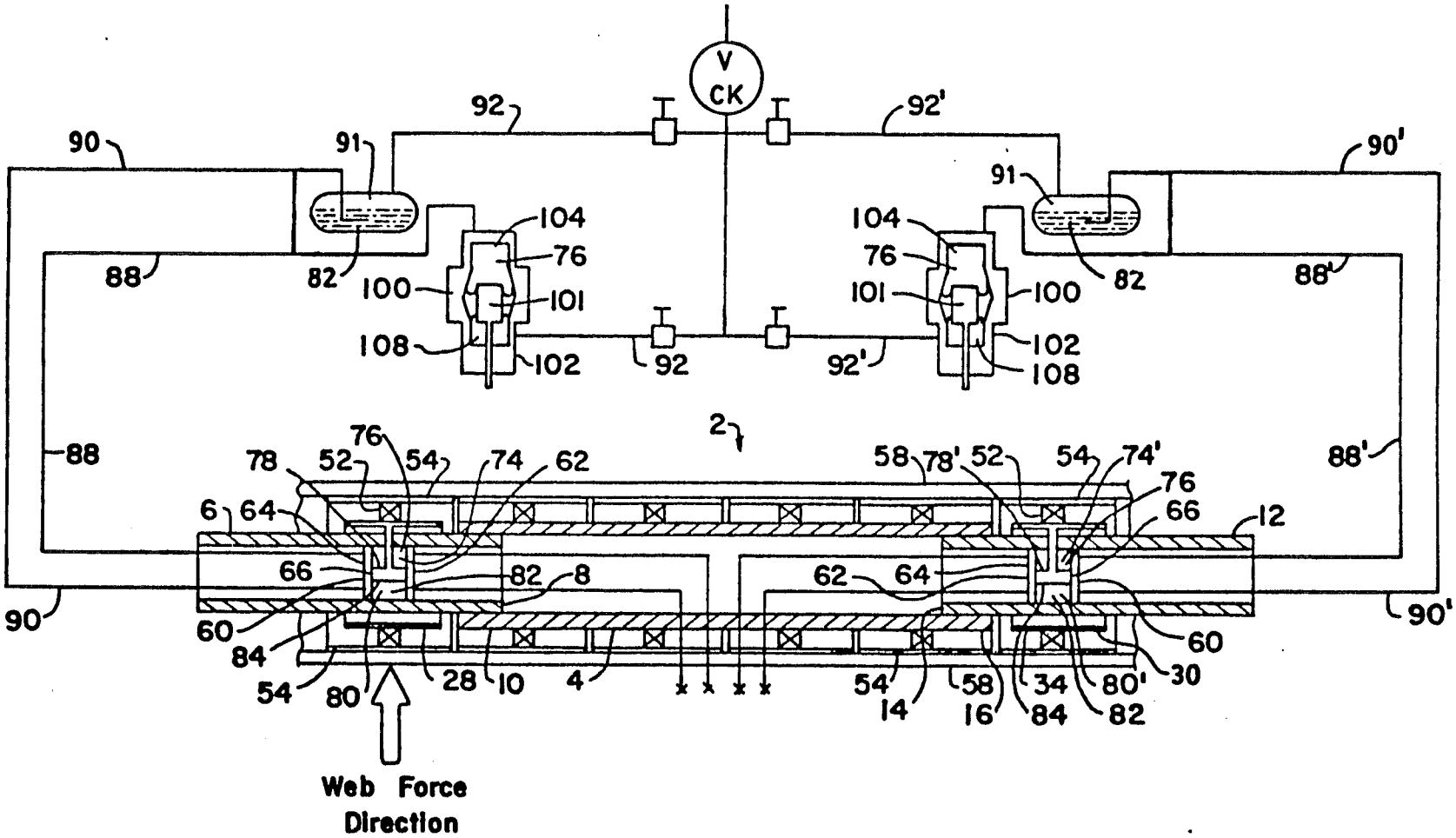
FIG. 2 is a partially sectional, partially diagrammatic view of a fluid circuit, shown in conjunction with a portion of the roll assembly, and illustrative of an embodiment of the invention.

Referring to FIG. 2, in which portions of end axle members 6, 8 are shown, it will be seen that the end 8 of the first end axle member 6 is disposed within the central axle member 4 and that, in like manner, the end 14 of the second end axle member 12 is disposed within the central axle member 4. Thus, the outside diameter of the central axle member 4 exceeds the outside diameters of the end axle members 6, 12 by twice the thickness of the central axle member tube wall.

Referring to FIG. 1, in which a portion of one end axle member 6 is shown in detail, it will be seen that a first end support ring means 20 is disposed around the first end axle member 6. A substantially identical second end sleeve means (not shown) is disposed around the second end axle member 12. Similarly, first intermediate support ring means 24 is disposed around the first end axle member 6 between the central axle member 4 and the first end support ring means 20. In the embodiment illustrated, the first intermediate support ring means 24 comprises intermediate support ring 28. The first intermediate support ring means 24 may include additional support rings, as shown in the above referred to related patent application, which is incorporated herein by reference. Second intermediate support ring means 30 (FIG. 2) is disposed in similar fashion around the second end axle member 12 between the central axle member 4 and the second end support ring means. In the embodiment illustrated, the second intermediate support ring means 30 comprises intermediate support ring 34. The second intermediate support ring means 30 may also include additional support rings, as shown in the above referred to related patent application.

Mounted on each of the support ring means 20, 28, 34, the second end sleeve means, and the central axle member 4, are spool means 50 comprising bearings 52 and rotatable spool shells 54. Each of the bearings 52 is supported by a support ring means or the central axle member 4. Roll surface means 58, preferably a rubber-like sleeve, is mounted on the spool shells 54 and is rotatable therewith and is adapted to engage a web material, not shown herein, but shown in the above-mentioned related application.

In FIG. 1, it will be seen that moving means 60 are disposed within the end axle members 6, 12 (axle member 6 shown in FIG. 1) and operate to automatically move the support ring means 20, 24, 30 relative to the end axle members to cause movement of the spool shells 54, and thereby the roll surface means 58, to automatically alter the pressure exerted on the web material by the roll surface means 58.

The moving means 60 for each of the support ring means are mounted on rigid bars 61 disposed in the end axle members and each comprises a piston and cylinder assembly 62, including a cylinder 64, a piston 66 disposed in the cylinder 64, and a piston pin means 68 extending from the piston 66 through an opening 70 in the end axle member. A distal end 72 of the piston pin means 68 is connected to the support ring means 20, 24, 30. In the embodiment illustrated in FIG. 1, the end support ring means 20, which is heavier than the intermediate support rings and which is not as well stabilized by the roll surface means, is connected to two of the piston and cylinder assemblies 62. The intermediate support ring 28 is connected to a single piston and cylinder assembly 62. Each cylinder 64 in the end axle member 6 is provided with a first chamber 74 for a first fluid 76 acting on a first pressure surface 78 of the piston 66 and a second chamber 80 for a second fluid 82 acting on a second pressure surface 84 of the piston 66. Similarly, each cylinder 64 in the second end axle member 12 is provided with a first chamber 74' for the first fluid 76 acting on a first pressure surface 78' of the piston 66 and a second chamber 80' for the second fluid 82 acting on a second pressure surface 84' of the piston 66, shown diagrammatically in FIG. 2.

As may be seen in FIG. 1, the chambers 74, 80 are provided with diaphragm members 86, such that the chambers are sealed except for fluid inlet and outlet means in each of the chambers. In like manner, diaphragm members are provided in the chambers 74' and 80'. All of the first chambers 74, of which two are shown in FIG. 2 for illustrative purposes, comprise part of a first circuit 88 containing the first fluid 76, and each of the second chambers 80 comprise part of a second circuit 90 containing the second fluid 82. Similarly, all of the first chambers 74', one being shown in FIG. 2 for illustrative purposes, comprise part of a third circuit 88' containing the first fluid 76, and each of the second chambers 80' comprise part of a fourth circuit 90' containing the second fluid 82. The first fluid 76 and the second fluid 82 preferably are liquids, such as oil. In operation, the second fluid is maintained under substantially constant pressure.

In each of the second and fourth fluid circuits 90, 90', there is disposed a liquid/gas tank 91 (FIG. 2) in which a gas, such as air, from a respective gas circuit 92, 92', is maintained under substantially constant pressure and acts upon a reservoir for the second fluid 82.

In each of the first and third fluid circuits 88, 88' there is disposed a master cylinder assembly 100 (FIGS. 2 and 3) comprising a master piston 101 housed in a master cylinder 102 having a first master chamber 104 in communication with one of the first or third fluid circuits 88, 88' and adapted to contain the first fluid 76 for acting on a first master piston pressure surface 106 and a second master chamber 108 in communication with one of the gas circuits 92, 92', and adapted to contain the gas for acting on a second master piston pressure surface 110.

Figure 3:
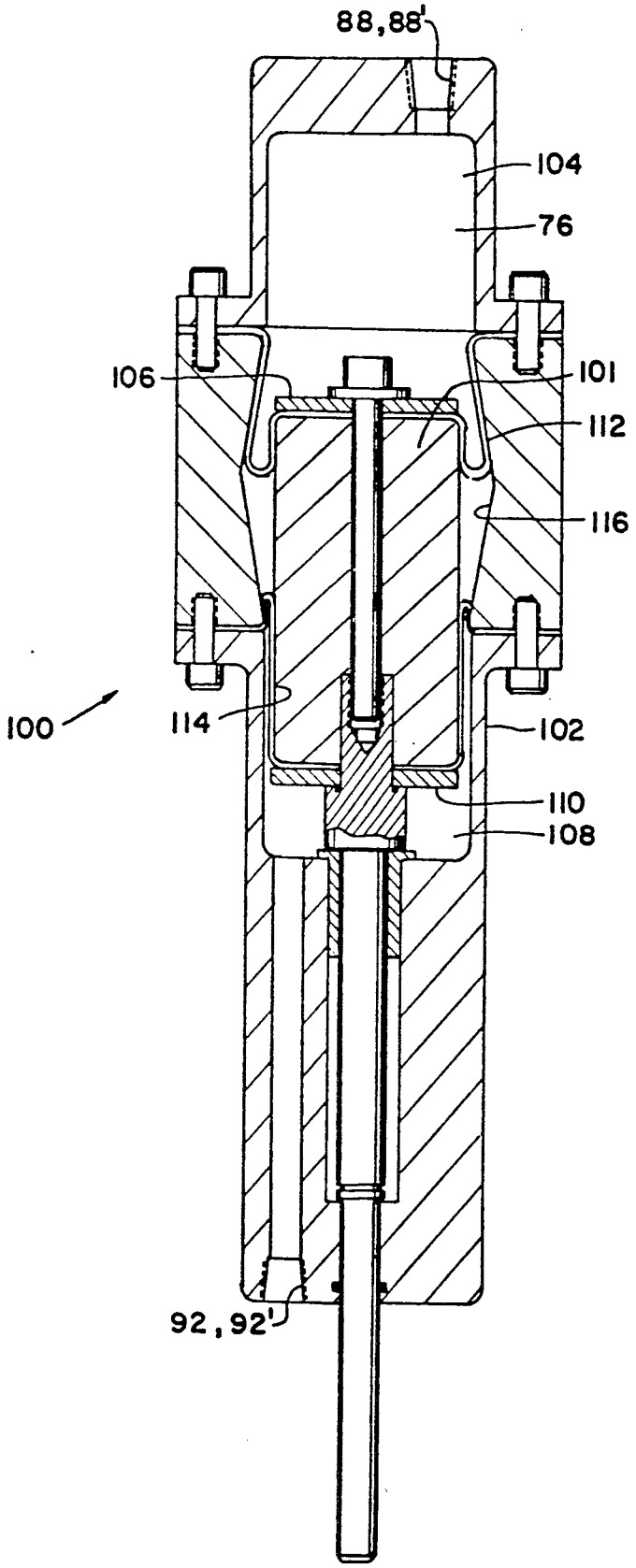
FIG. 3 is a sectional view of the master cylinder component of the fluid circuit of FIG. 2.

Each master cylinder assembly 100 is provided with a first rolling diaphragm 112 (FIG. 3) interconnecting the wall of the first master chamber 104 and the first master piston pressure surface 106, and a second rolling diaphragm 114 interconnecting the wall of the second master chamber 108 and the second master piston pressure surface 110. The master cylinder 102 is provided with a double tapered side wall 116 (FIG. 3). The tapers are structured such that as the master piston 101 moves, the effective area of one diaphragm is increased while the effective area of the other diaphragm is decreased. As the diaphragms move toward the center of the cylinder, more of the diaphragms is exposed to pressure and the diaphragms become pressure surface extensions of the pressure surfaces 106, 110. A substantially constant gas pressure exists in the second master chambers 108 and the second and fourth fluid circuits 90, 90'. The pressure in the first master chambers 104 and the first and third fluid circuits 88, 88' varies in response to a change in pressure between the roll and the web, which causes movement of the pistons 66, which in turn causes movement of the master piston 101. The changing first and third fluid circuit pressures create changing forces in the first and third fluid circuits 88, 88', and the piston and cylinder assemblies' first chambers 74, 74' in the opposite direction of a changing force on the support ring means 20, 24, 30.

In operation, the above-described roll assembly operates to correct the problem of slack edges in a web of material by automatically adjusting its end profile to maintain a selected web tension.

The piston and cylinder assemblies 62 are set by selection of pressure in the gas/liquid tanks 91, and thereby the pressure in the second and fourth circuits 90, 90' such that the various forces acting upon the support ring means are balanced; that is, the weight of the roll, the tension on the web, and the like, are in equilibrium. As a rolling operation progresses, the above-described roll assembly operates to correct the problem of slack or overly-tensioned edges in a web of material by automatically adjusting its end profile to maintain a selected web tension. For example, the web running over the ends of the roll may be slack for lack of proper contact with the roll's ends. If web tension at an end of the roll is less than that for which the system is set first fluid 76 pressure urges a spool 54 (FIG. 1), and thereby the roll surface means 58, downwardly into the web. As first fluid 76 leaves the master cylinder chamber 104, through the circuit 88, to enter the first chambers 74 of the piston and cylinder assemblies 62, the master cylinder tapered walls 116 cause the first fluid pressure to increase in the circuit 88 to create greater force in the chambers 74, to maintain the spool 54 in its adjusted position until there is a change in rolling conditions. As the spool 54 moves downwardly to urge the roll surface means 58 into more forceful contact with the web, pressure in the chambers 74 is required to overcome the tendency of the roll surface means 58 to return to its original position. The master cylinder operates, through the fluid circuits 88, 88', to maintain pressure in the chambers 74, 74' sufficient to overcome slack conditions as they occur, and also to balance the spring bias of the surface means 58 toward its "neutral" position.

It is to be understood that the present invention is by no means limited to the particular construction herein disclosed and/or shown in the drawings, but also comprises any modifications or equivalents within the scope of the disclosure.

Having thus described our invention what we claim as new and desire to secure by Letters Patent of the United States is:

1. A fluid circuit for maintaining substantially constant pressure between two abutting solid objects, said circuit comprising a master cylinder assembly, a plurality of working cylinder assemblies, each of said working cylinder assemblies comprising a working cylinder, a working piston disposed in said working cylinder, a piston rod fixed to said working piston and extending from said working cylinder, and end means on a distal end of said piston rod comprising a first of said solid objects and adapted to engage a surface comprising a second of said solid objects, against which it is desired to maintain constant pressure, each of said working cylinders having therein a first chamber for a first fluid acting on a first pressure surface of said working piston and a second chamber for a second fluid acting on a second pressure surface of said working piston, said master cylinder assembly comprising a master cylinder, said master cylinder having a first master chamber for said first fluid acting on a first pressure surface of said master piston assembly and in communication with said first chambers of said working cylinders, said master cylinder having a second master chamber in communication with a source of gas under a selected substantially constant pressure, said gas acting on a second pressure surface of said master piston assembly, and a liquid/gas tank, a liquid reservoir portion of said tank being in communication with said second chambers of said working cylinders, a gas reservoir portion of said tank being in communication with said master cylinder second master chamber, and said master piston first and second pressure surfaces being variable, such that upon change of pressure on said end means by said second object, a reaction is generated in said circuit such as to move said end means to restore a desired pressure on said end means by said second object.

2. The fluid circuit in accordance with claim 1, in which said master cylinder assembly is provided with double tapered internal walls, a first diaphragm interconnecting walls of said first master chamber and said first pressure surface of said master piston, and a second diaphragm interconnecting walls of said second master chamber and said second pressure surface of said master piston.

3. The fluid circuit in accordance with claim 2 in which said diaphragms comprise rolling diaphragms operable in conjunction with said tapered walls to increase effective area of one of said diaphragms while decreasing effective area of the other of said diaphragms.

4. The fluid circuit in accordance with claim 3 in which said rolling diaphragms, as they move toward a center of said cylinder, increase their area and thereby increase said piston pressure surfaces, respectively.

5. The fluid circuit in accordance with claim 3 in which said first and second fluids comprise a liquid.

6. A master cylinder assembly for use in combination with a plurality of working cylinder assemblies, said master cylinder assembly comprising a master cylinder having double tapered walls such that the diameter of said cylinder at its mid-section exceeds the diameter of said cylinder elsewhere, a piston disposed in said cylinder, a first rolling diaphragm interconnecting walls of a first chamber of said cylinder with a first pressure surface of said piston, and a second rolling diaphragm interconnecting walls of a second chamber of said cylinder with a second pressure surface of said piston, such that as said diaphragms move toward said mid-section of said cylinder their areas increase and said diaphragms become pressure surface extensions of said piston pressure surfaces, and as said diaphragms move away from said center of said cylinder their areas decrease to diminish said pressure surface extensions, the arrangement being such that as one diaphragm increases in area the other decreases in area.

* * * * *